United States Patent [19]

Hanyu et al.

[11] Patent Number: 4,998,491

[45] Date of Patent: Mar. 12, 1991

[54] METHOD OF AUTOMATICALLY CONTROLLING UPPER THREAD TENSION IN A SEWING MACHINE

[75] Inventors: Susumu Hanyu; Noboru Kasuga; Kazumasa Hara; Shuzo Morimoto, all of Tokyo, Japan

[73] Assignee: Janome Sewing Machine Co. Ltd., Tokyo, Japan

[21] Appl. No.: 209,856

[22] Filed: Jun. 22, 1988

[30] Foreign Application Priority Data

Jun. 26, 1987 [JP] Japan ..... 62-157622

[51] Int. Cl.[5] ..... D05B 49/00

[52] U.S. Cl. ..... 112/262.1; 112/243; 112/255

[58] Field of Search ..... 242/150 R; 112/254, 112/243, 262.1, 302, 255, 241

[56] References Cited

U.S. PATENT DOCUMENTS 4,340,003 7/1982 Hanyu et al. ..... 112/254 X
4,408,554 10/1983 Takiguchi et al. ..... 112/243 X
4,616,583 10/1986 Takano et al. ..... 112/254 X
4,690,083 9/1987 Hara et al. ..... 112/254
4,791,876 12/1988 Sasaki et al. ..... 112/255 X

*Primary Examiner*—Andrew M. Falik
*Attorney, Agent, or Firm*—Michael J. Striker

[57] ABSTRACT

A method of automatically controlling thread tension in a sewing machine according to which a first thread tension device is provided between an upper thread source and a thread take-up lever, and a second thread tension device is provided between the first tension device and the thread take-up lever. The first thread tension device is operated to apply a constant pressure to the upper thread such that the thread take-up lever is able to draw out the upper thread upon moving upward. The second thread tension device is operated to fixedly hold the upper thread until the thread take-up lever moves upward to an upper dead point thereof through a lower dead point thereof, at which the take-up lever moves downward to supply the upper thread to the needle. The second thread tension device is further operated to effect release of the upper thread when the thread take-up lever reaches the upper dead point thereof and until the thread take-up lever moves downward to a thread supply starting position thereof.

1 Claim, 7 Drawing Sheets

METHOD OF AUTOMATICALLY CONTROLLING UPPER THREAD TENSION IN A SEWING MACHINE

FIELD OF THE INVENTION

The present invention relates to a sewing machine and, more particularly to a method of automatically controlling thread tension in a sewing machine.

BACKGROUND OF THE INVENTION

In the prior art, for controlling thread tension, a thread tension dial of an upper thread tension device was controlled by trial stitching such that in a straight stitching, an upper thread and a lower thread were crossed at a center in thickness of a fabric as seen in FIG. 6(*a*), and in a zigzag stitching or one cyclic stitching the upper thread appeared at a rear side of the fabric as seen in FIG. 7(*a*).

For automatic thread tension control, there have been many proposals of controlling an upper thread tension or an upper thread supply in response to fabric thickness, thread thickness or types of pattern to be stitched With the above-mentioned control, the crossing points are confirmed by a trial stitching. This is why the upper thread tension control is not sufficient without different properties of the threads being considered as they may cause variations in the thread elongation.

With respect to changing in the thread crossing points, if the stitching is carried out at the same position of the tension dial, i.e., at the same pressure with the threads having a small elongation, the upper thread appears at the rear side of the fabric as seen in FIG. 6(*c*), i.e., resulting in the lower crossing, but on the other hand, in a case of the thread having a substantial elongation, the upper thread appears at the rear side of the fabric as seen in FIG. 6(*b*), i.e., resulting in the upper crossing

SUMMARY OF THE INVENTION

The present invention proposes a method of automatic control of thread tension which solves the above-mentioned phenomena without causing such variances in the stitches to be formed.

Dependent on thread elongation characteristics, the small amount of thread is drawn in advance from a thread supply source in addition to drawing the upper thread by raising a take-up lever The additional amount of the thread is supplied to a thread running path extending from a thread tension device to a needle eye, to decrease the influence of thread elongation on tightening the thread.

The additional amount of the thread supplied to the thread running path, is small for a thread having a small elongation, and is large for a thread having a substantial elongation.

The upper thread is pre-supplied in response to the thread elongation by lowering the pressure of the tension device when a phase is reached in which the thread take-up lever moves from an upper dead point of the take-up lever. The amount to be supplied is responsive to differences in elongation characteristics.

BRIEF DESCRIPTION OF THE DRAWINGS

FIG. 6(*b*) is a perspective view of a straight stitch showing one type of a typical example of an incorrect stitch;

FIG. 6(*c*) is a perspective view of a straight stitch showing another type of a typical example of an incorrect stitch;

FIG. 7(*b*) is a perspective view of a zigzag stitch showing a typical example of an incorrect stitch, in which the upper and lower threads are interlocked on the upper side of the fabric;

DETAILED DESCRIPTION OF PREFERRED EMBODIMENTS

The present invention will be explained with reference to embodiments shown in the attached drawings.

Figure 4:
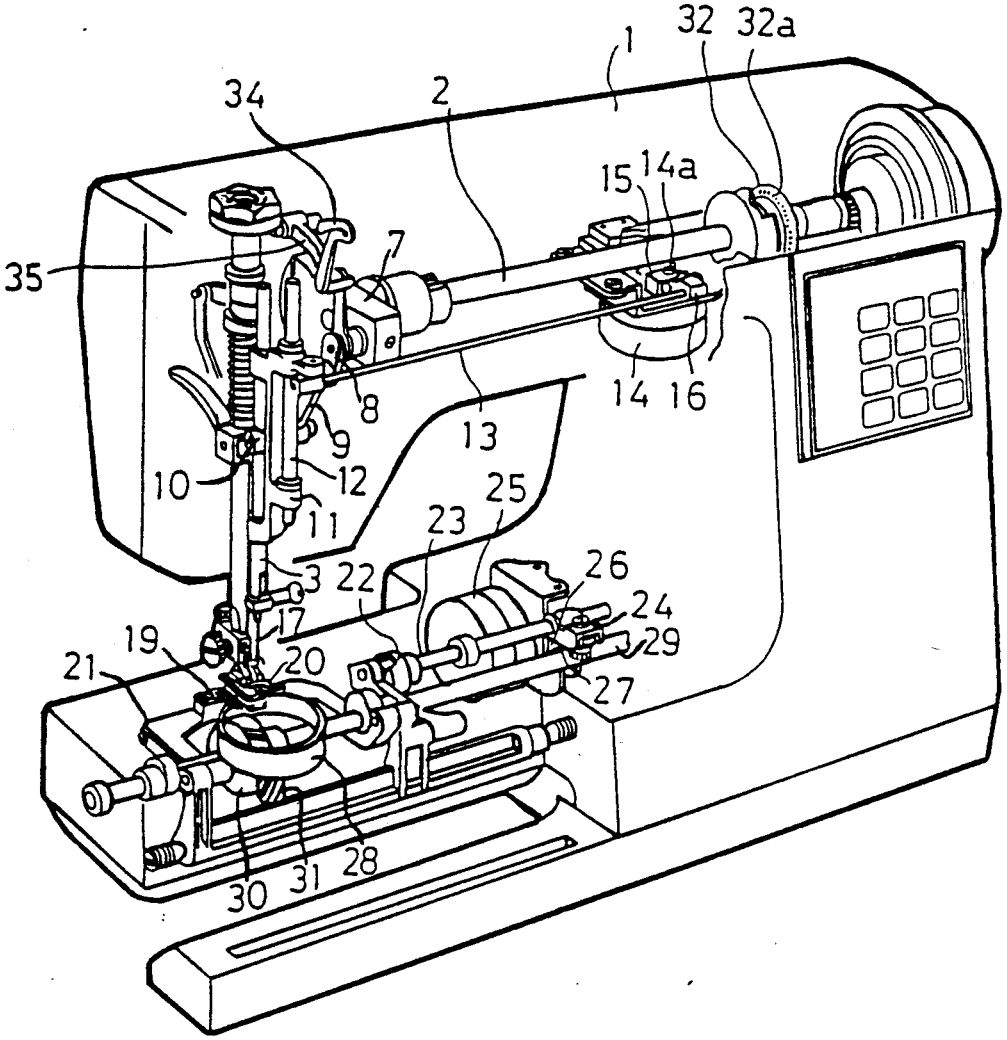
FIG. 4 is a perspective view showing a mechanism of the sewing machine of FIG. 3.
Figure 18:
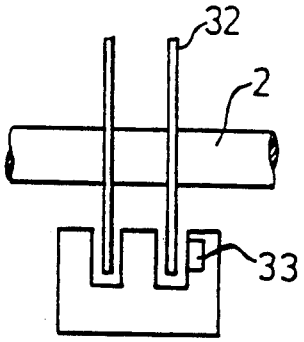

FIG. 4 shows the structure of the sewing machine, in which a sewing machine frame 1 is provided with a needle bar 3 movable in a vertical direction. The needle bar 3 is connected to an upper shaft 2 which is connected with a drive part (not shown) and is rotated thereby. The needle bar 3 is fixed in a needle bar holder 10 which is inserted at its upper and lower parts in a needle bar supporter 11. The drive shaft 2 is rotatably supported on the machine frame 1, and a crank 7 is provided at an end of the upper shaft 2. A crank rod 9 is rotatably connected to an end of a needle bar crank 8 which is secured to an end of the crank 7. The needle bar supporter 11 is mounted on a shaft 12 secured to the machine frame 1, and is restricted with respect to vertical movements and rotates only. The needle bar supporter 11 is connected by its end to one end of a rod 13 which is connected, via a link 126, at its other end to an arm 15 secured on an output shaft 14*a* of a needle amplitude stepping motor 14.

A feed dog 19 is mounted on a horizontal feed arm 21 operatively connected and driven by a lower drive shaft 29 which is operatively connected to the drive shaft 2. The movement of the horizontal feed arm 21 is adjusted by turning, and a turning angle adjusting member 22 is fixed on the end of an adjusting shaft 23, so that the amount of rotation transmitted to the horizontal feed arm 21, is adjusted by rotating the member 23. An arm 24 secured on the end of the shaft 23, is connected to a crank 26 mounted on the output shaft of a feed adjustment stepping motor 25 secured to the machine frame 1.

In FIG. 4, a rotation disk 32 is secured on the upper shaft 2, and a device for detecting rotational phase of the upper shaft 2 is composed of slits formed in the rotation disk 32 and a photointerrupter 33 secured on the machine frame 1. A take-up lever 34 having a link shape, is connected to the upper shaft 2 via a link 35.

The lower drive shaft 29 is rotated in synchronism with the upper drive shaft 2 to rotate a loop taker 28 of a horizontal type by means of gear 30 secured to the lower drive shaft, and another gear 31 secured to the loop taker and meshing with gear 30. The loop taker 28 rotates synchronously with the needle 17 and the thread take-up lever 34 and catches a thread loop which is formed as the needle is going up from the lower dead point thereof, to thereby interlock the needle thread (upper thread) with a lower thread (not shown), which is stationarly carried in the loop taker, to form a stitch which is tightened by the thread take-up lever 34 as the latter goes up.

Figure 3:
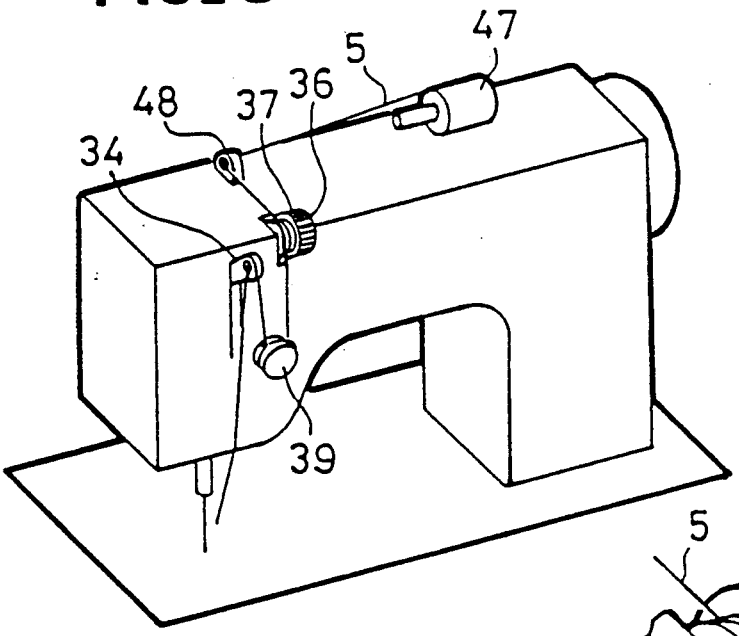
FIG. 3 is a perspective view of a sewing machine including the automatic thread tension control according to the present invention.
Figure 8:
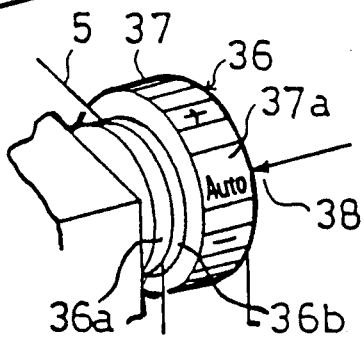
FIG. 8 is a perspective view of an upper thread tension device used in connection with the invention.

In FIG. 3, a first upper thread presser device 36 is a thread tension device of a known mechanism for applying a predetermined spring force to a pair of thread holding disks 36*a*, 36*b*, as seen in FIG. 8.

If a thread tension dial 37 of the first upper thread presser device 36 is rotated, it is possible to control pressure to the pair of thread holding disks 36*a* 36*b*. "Auto" 37*a* is marked in calibrations of the dial 37, and if it is set to an indicator 38 marked in the surface of the machine frame 1, it is possible to impart pressure suitable for ordinary fabrics. This function may be performed by a second upper thread pressure device 39.

Figure 5:
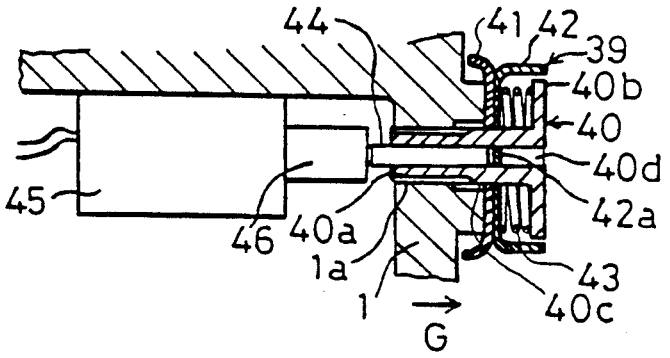
FIG. 5 is a partially cross-sectional side elevational view of an intermittently operated upper thread presser according to the invention.

The second upper thread presser device 39 is an intermittent presser device which presses and releases the upper thread during one cycle of forming the stitches, and is positioned between the first device 36 and the take-up lever 34. This device 39 has a structure as shown in FIG. 5, in which a screw portion of a brimmed screw 40 is screwed into a hole 1*a* defined in the machine frame 1, and the shaft 40*c* of the brimed screw 40 is formed with a hole 40*a*.

Figure 13:
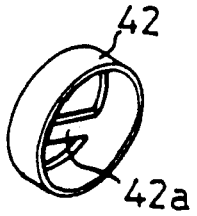
FIG. 13 is a partially sectional perspective view of the second embodiment of an intermittently operated upper thread presser.

A pair of thread holding disks 41 and 42 are mounted on the shaft 40*c*. A slitted groove 40*d* is formed from a brim 40*b* to the shaft 40*c*, and the thread holding disk 42 is shaped as seen in FIG. 13, and has a rib 42*a* fitted in the slitted groove 40*d*, so that the disk 42 is controlled in rotation and is allowed to axially move only. A spring 43 is provided between the disk 42 and the brim 40*b* so as to press the disks 41 and 42. If the screw 40 is rotated via the slitted groove 40*a*, the brim 40*b* is axially moved by the screw 40*a* to control pressure of the spring 43. The brim 40*d* is made integral with the shaft 40*c* by using an adhesive cement, after having the disks 42 and the spring 43 set.

A pin 44 is slidable in the hole of the brim screw 40 and connects the rib 42*a* of the disk 42 at its one end, and contacts the output shaft 46 of a solenoid 45 at its other end.

Referring to FIGS. 1, 2 and 9 to 12, an explanation will be made to operations when the stitches are formed by using the embodiment described above.

An upper thread 5 from a thread supply 47 is guided between the pair of thread holding disks 36*a*, 36*b* of the first upper thread presser device 36 via a thread guide 48 and is further guided between the pair of thread holding disks 41, 42 of the second upper thread presser device 39, and passes through a take-up lever 34 to the eye of the needle 17.

Figure 1:
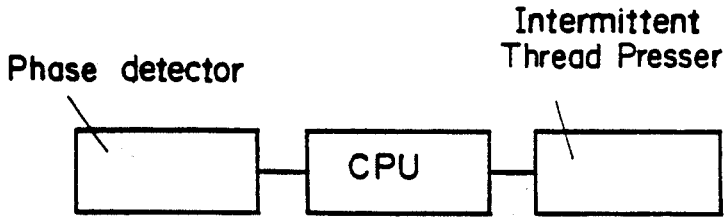
FIG. 1 is a block diagram according to the invention for controlling of an upper thread in a sewing machine.
Figure 2:
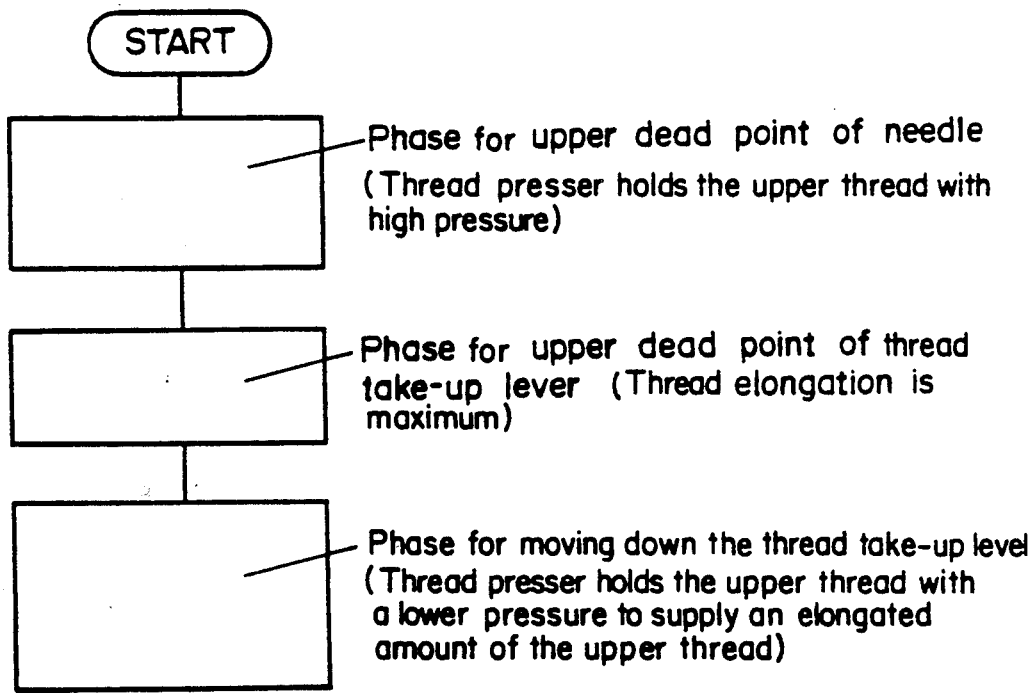
FIG. 2 is an explanatory block diagram showing a sequential upper thread tension control.
Figure 6A:
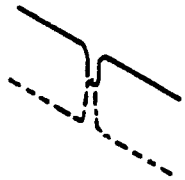
FIG. 6(*a*) is a perspective view of a straight stitch showing a typical example of a correct stitch.
Figure 6B:
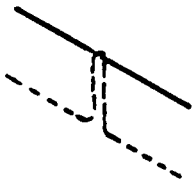
Figure 6C:
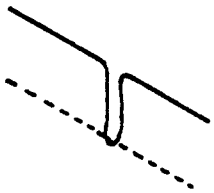
Figure 7A:
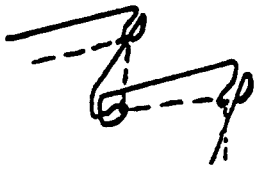
FIG. 7(*a*) is a perspective view of a zigzag stitch showing a typical example of a correct stitch, in which the upper and lower threads are interlocked on the underside of a fabric.
Figure 7B:
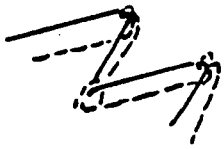
Figure 9:
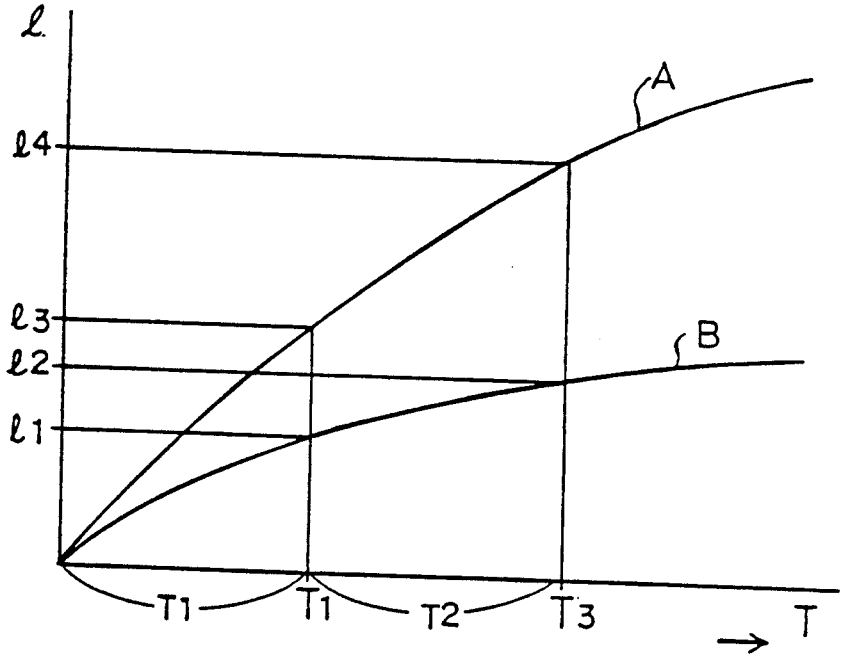
FIG. 9 is a graphic view showing relations between pressures applied to different types of threads and resulting elongations of the threads.

FIG. 9 shows the relationship between the pressure applied to the upper thread, and the elongation amount of the upper thread at the upper dead point of the take-up lever in the sitch-forming cycle where the abscissa is the pressure T applied to the upper thread, and the ordinate is an elongation amount $\rho$ of the upper thread as the take-up lever goes up. "A" in FIG. 9 shows a case of a polyester filament thread that has a substantial elongation, when the stitches are formed at the upper crossing as seen in FIG. 6(*b*) under the same thread tensioning condition. "B" shows a case of a cotton thread having a smaller elongation, when the stitches are formed at the lower crossing as seen in FIG. 6(*c*) under the same thread tensioning condition.

The first upper thread presser device 36 always provides constant thread holding force $T_1$ during stitching cycles, and the second upper thread presser device 39 provides strong thread holding force $T_2$ by pressure of the spring 43 as seen in FIG. 5 for a period from a phase where the elongation of the upper thread is almost eliminated by descending of the take-up lever 34 to a lower dead point of the take-up lever In other phases, the solenoid 45 is operated to contact the pin 44 in a direction of arrow G. The pin 44 acts on the rib 42*a* of the disk 42 so that the disk 42 is pushed up against the pressure of the spring 43 to thereby change the thread holding pressure The changed holding pressure $T_2$ is, thus, determined by moving positions of the solenoid 45.

A further explanation will be given with reference to FIGS. 1, 2, 4 and 10. When the sewing machine is driven, the needle comes to the upper dead point thereof at the rotation angle $\theta_0$ of the upper drive shaft 2 of the sewing machine. Meantime, the thread take-up lever 34 goes up tensioning the upper thread, the thread tension device 36 is set to provide a constant tension $T_1$ to the upper thread, and the intermittently operated presser 39 is operative to hold the upper thread under the control of CPU providing a tension $T_2$ to the upper thread in addition to the tension $T_1$ so that a total tension $T_3$ is applied. As the upper drive shaft 2 is rotated to the rotation angle $\theta_1$ while the thread take-up lever 34 reaches the upper dead point thereof, and the upper thread is elongated to a maximum. The phase detector 32, 33 detects the rotation angular position (phase) of the upper drive shaft 2 and provides a signal to CPU, which in response to the signal makes the intermittently thread presser 39 inoperative to release the upper thread. As the upper drive shaft 2 is further rotated past the rotation angle $\theta_1$ to move down the thread take-up lever 34 while the thread elongation disappears, the phase detector 32, 33 again detects the rotation angle and provides a signal. CPU in response to the signal makes the intermittently operated thread presser operative to hold the upper thread again until the upper drive shaft 2 comes to the rotation angle $\theta_1$. The operation of the thread presser 39 may be controlled more smoothly as shown with a dotted line in FIG. 10.

An explanation will be made to when the thread holding force is released by operation of the solenoid that is, when $T_2$ is reduced to 0.

When the constant force $T_1$ is applied to the conventional first presser device 36 only, the elongation $\rho_1$ is generated in the cotton thread as the upper thread, and the elongation $\rho_3$ is generated in the elongation polyester filament thread, where the upper thread influences tightening the stitches at the upper dead point of the take-up lever 34 during the stitching cycle. When the take-up lever 34 goes upward, the upper thread is supplied from the first device 36 to the needle 17, and the supply amount of the upper thread is decreased by the amount of elongation and the more is the elongation, the higher is the crossing position On the other hand, in the present embodiment, the upper thread is held by thread holding force $T_3$ at the upper dead point of the take-up lever 34 during the stitching cycle, where the holding force $T_1$ by the first device 36 is summed with the holding force $T_2$ by the second device 39, so that when the stitches are tightened, the elongation $\rho_2$ is generated in the cotton thread as the upper thread and the elongation $\rho_4$ is generated in the polyester filament thread of the same shown with "A", as in FIG. 9.

When the second device 39 is released after the dead point of the take-up lever 34, the thread holding force $T_1$ is provided only by the first device 36, shown in FIG. 9. Since elongation of the thread is $\rho_1$ in the cotton thread and is $\rho_3$ in the polyester filament thread, the upper threads 5 are assigned elongations and $\rho_3$ and $\rho_1$ after the dead point of the take-up lever 34 by the operation of the solenoid 45 with respect to the elongations $\rho_4$ and $\rho_2$ at the dead point of the same, so that the thread of differences of $\rho_4$ minus $\rho_3$ and $\rho_2$ minus $\rho_1$ is pre-supplied in the upper thread running path from the upper thread tension device 36 to the forming of stitches.

If the value of $T_2$ is set such that "$\rho_4-\rho_3$" is larger than "$\rho_2-\rho_1$", the upper thread of the polyester filament having the characteristic of $\rho_4-\rho_3$, is supplied in a greater amount to the path than the cotton thread having the characteristic of $\rho_2-\rho_1$. Thus, the elongation characteristic of the thread can be compensated.

If the value of $T_2$ is set such that the difference between the thread types is made equal to the difference between $\rho_3$ and $\rho_1$, the supply amount is determined by the values of $T_1$ and $T_2$ in the relation with the elongation characteristics of the stitching thread.

The operating phase of the second device 39 is controlled by the solenoid 45 by a detection phase of the detector of the phase of the upper shaft.

Figure 11:
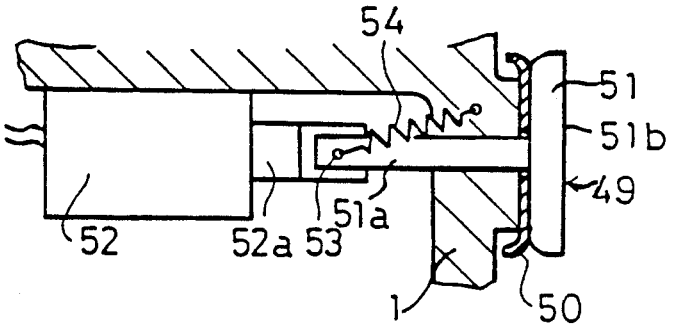
FIG. 11 is a partial cross-sectional side elevational view of a second embodiment of intermittently operated upper thread presser according to the invention.

A second embodiment will be explained with reference to FIGS. 11 and 12.

Figure 10:
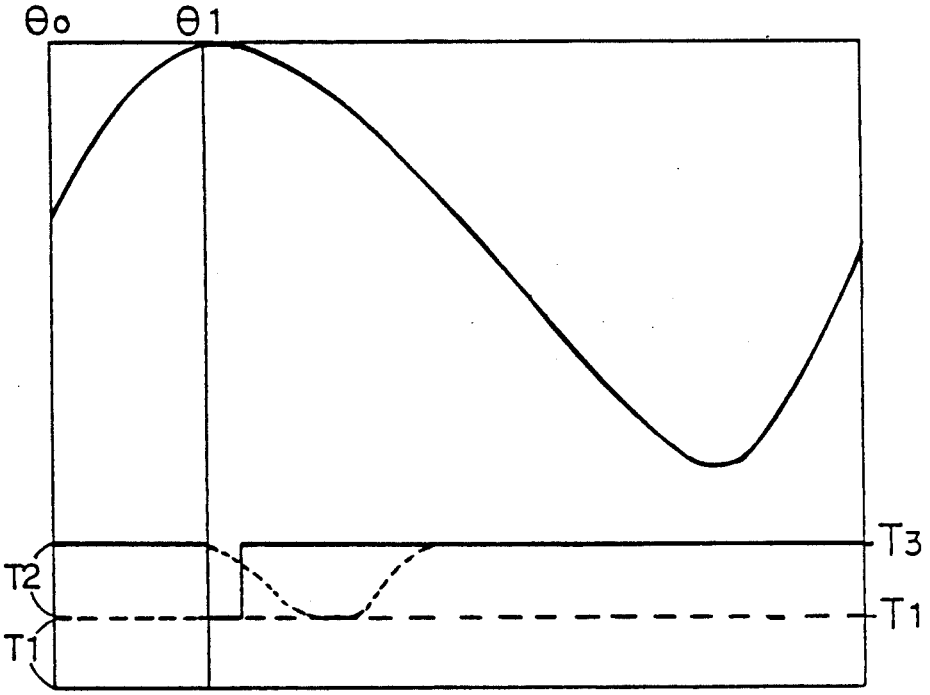
FIG. 10 is a graphic view showing a relation between an amount of thread supply by a thread take-up lever and operations of first and second thread tension adjusting devices according to the invention.
Figure 12:
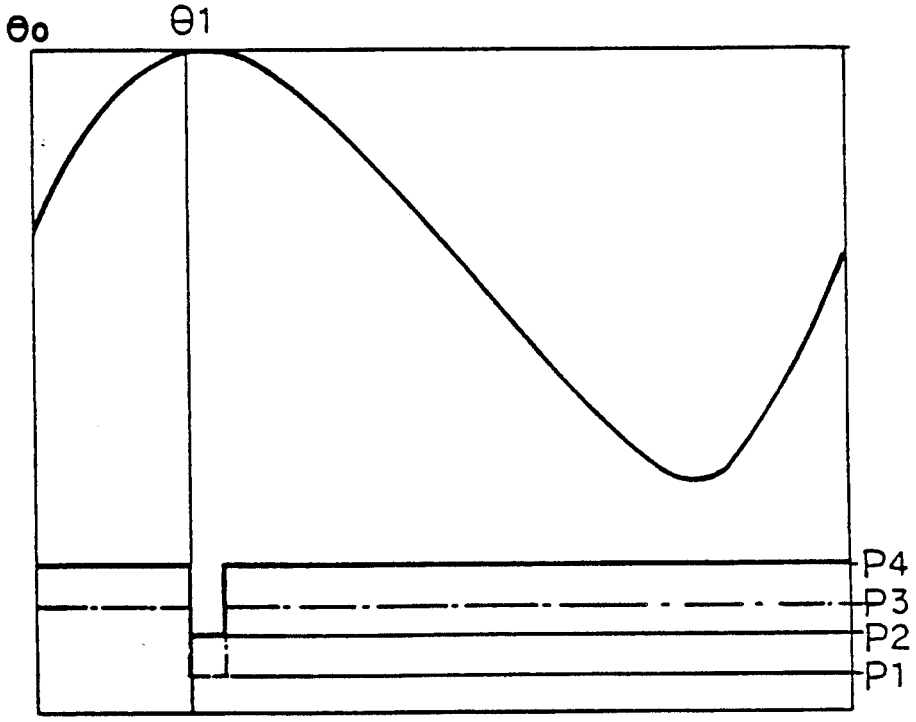
FIG. 12 is a graphic view showing a relation between an amount of thread supply by a thread take-up lever and operations of a second embodiment of intermittently operated upper thread presser.

FIG. 12 shows, in the same way as FIG. 10, a rotational angle of the upper drive shaft on the abscissa, and the movement of the thread take-up lever (upper thread supply) on the ordinate. In this figure, the relative movements of the upper drive shaft 2, the needle 17 and the thread take-up lever are the same as in FIG. 10.

The time of operation of the upper thread pressure 49 is the same as this of presser 39 in FIG. 10. The upper presser 49 is set to operate four steps $P_2$ to provide a lower pressure to the upper thread, $P_4$ for providing a higher pressure to the upper thread in case of straight stitches when a comparatively high thread tension is required, $P_1$ for providing a further lower pressure to the upper thread, and $P_3$ for providing a higher pressure to the upper thread in case of the zigzag stitches which require a comparatively lower thread tension.

In the second embodiment, an upper thread presser device 49 has the two functions of the first upper thread presser device 36 and the second upper thread presser device 39 in the same manner, as in the first embodiment.

An upper thread presser device 49 is disposed between the thread supply source 47 and the take-up lever 34 instead of the second upper thread presser device 39 in FIG. 3, the first upper thread presser device 36 being omitted in this embodiment. The end of a shaft portion 51*a* of a brimed shaft 51 connects, via a pin 53, an output shaft 52*a* of the solenoid 52 fixed to the machine frame 1. The brim shaft 51 comprises a brim 51*b* having a thread holding portion in relation with a thread holding disk 50.

The solenoid 52 has a structure shown in, for example, the Japanese Utility Model Publication No. 14,940/83, and is moved laterally by input to control the pressure exerted between the disk 50 and the brim 51*b*.

The thread holding pressure is set in four steps of $P_1$, $P_2$, $P_3$ and $P_4$. $P_2$ and $P_4$ are the pressure corresponding to $T_1$ and $T_3$ of the first embodiment, while $P_1$ and $P_3$ are set at pressure lower than $P_2$ and $P_4$. Therefore, pressure of this embodiment is set $P_4$, the strong pressure between the phase where the elongation of the upper thread 5 is almost eliminated by descending of the take-up lever 34 and the phase till the take-up lever reaches its upper dead point. The phase just after the upper dead point is detected by the phase detector to bring the solenoid 52 to $P_2$ of the lower pressure.

The operation that the strong pressure is imparted to the disks when the take-up lever 34 goes up and the weak pressure is imparted just after the upper dead point so as to cancel the influence to the stitches, is the same as in the first embodiment.

$P_2$ and $P_4$ are set for straight stitching which needs a stronger thread tension, and on the other hand, $P_1$ and $P_3$ are for zigzag stitching which needs a weaker thread tension, and set the thread crossing points at the center in thickness of the fabric. The stitching condition is to calculated similarly, and the first and second thread holding pressures are set in response to the stitching condition, to thereby determine the upper thread tension suitable for the stitching condition and answer to changing of the stitches by the thread elongation.

A further explanation will be made relative to a third embodiment with reference to FIGS. 14 to 17.

A sewing machine frame 1 has the same structure as in the first embodiment However, a thread drawing instrument 55 is provided between the thread supply 47 and a take-up lever 34 An intermittently operated thread presser 39 is placed between the thread supply 47 and the thread drawing instrument 55. A thread presser device 36 is provided between the thread drawing instrument 55 and the thread take-up lever 34. A thread guide 56 is fixed to the machine frame 1 adjacent to the thread drawing instrument 55. The thread guide 56 includes a pair of standing pins 56a, 56b arranged in parallel with the thread path as shown in FIG. 15.

Figure 15:
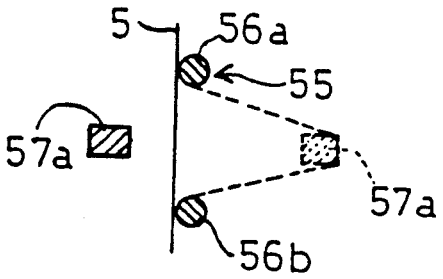
FIG. 15 is an explanatory vertical sectional view of a thread draw-out device according to the invention in which a thread draw-out member is moved between an inoperative position shown with a solid line, and an operative position shown with a dotted line.
Figure 16:
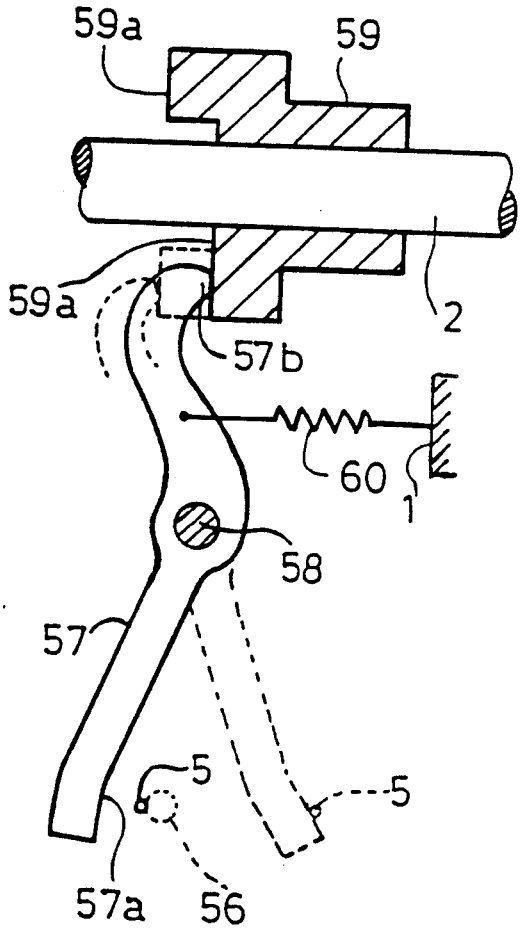
FIG. 16 is a plan view of the thread draw-out device in which the thread draw-out member is moved between the inoperative position shown with a solid line, and an operative position shown with a dotted line.
Figure 14:
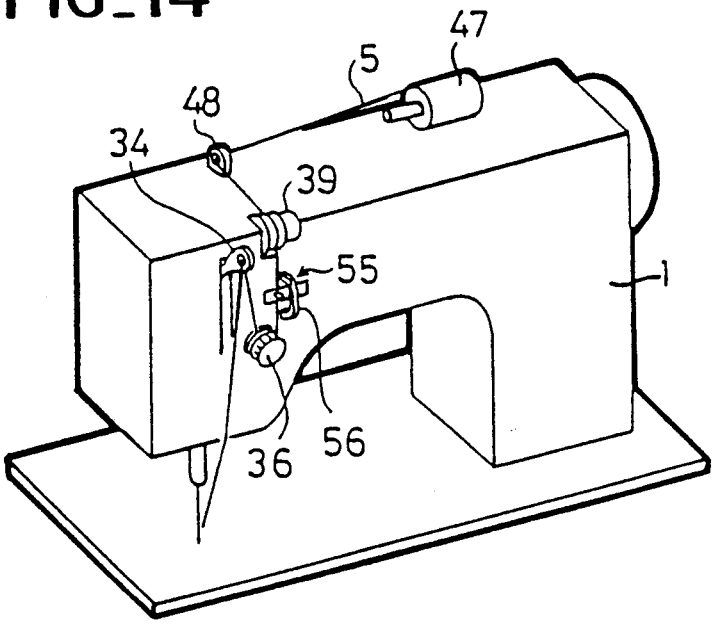
FIG. 14 is a perspective view of a sewing machine including a third embodiment of automatic thread tension control of the invention.

As shown in FIGS. 15 and 16, the thread drawing instrument 55 includes a thread drawing member 57 movable in lateral directions across the thread path. The drive mechanism of the drawing member 57 is, as shown in FIG. 16, and is rotatably pivoted about a pin 58 implanted in the machine frame 1. The thread drawing member 57 has at its one end an actuating portion 57a for the upper thread supported on the thread guide 56, and has at its other end a follower 57b contacting a cam face 59a of a thread drawing cam 59 mounted on the upper shaft 2. A spring 60 supported on the machine frame 1 at its end, is connected to the side of the follower 57b for biasing the drawing cam 59.

Figure 17:
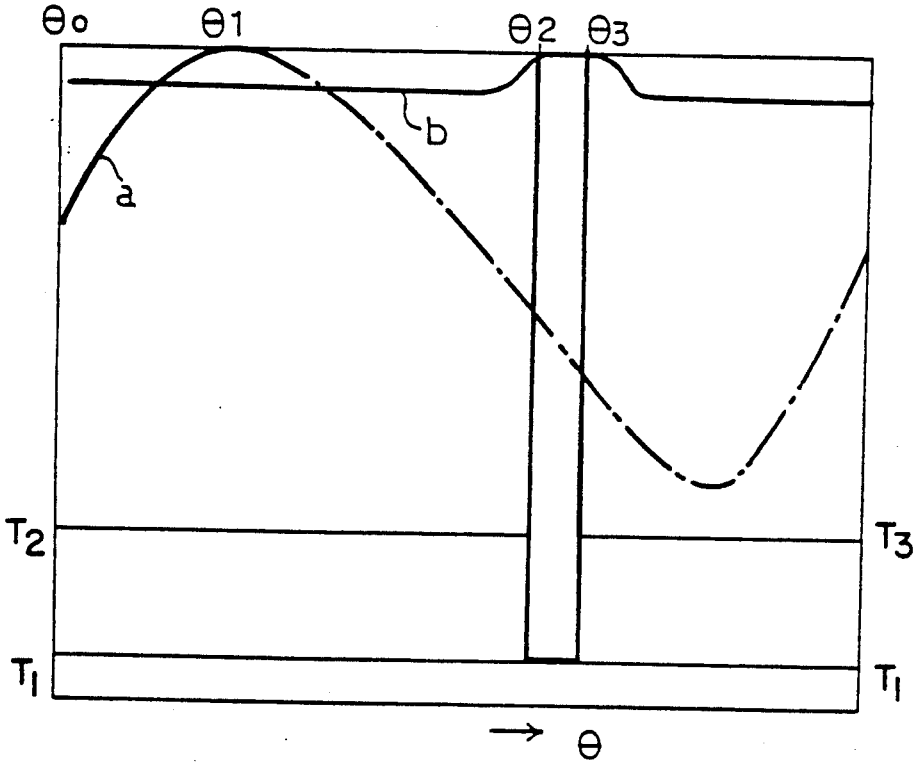
FIG. 17 is a graphic view showing a relation between an amount of thread supply by the thread take-up lever and operations of intermittently operated thread presser and the thread draw-out member.

The operation of this embodiment will be explained with reference to FIGS. 15 and 17. FIG. 17 shows a thread slacking amount a of the take-up lever 34, where the abscissa shows a rotational angle $\theta$ of the drive shaft, and the upper dead point is 0°. When the sewing machine is driven, the needle comes to its upper dead point at the rotational angle $\theta_0$ of the upper drive shaft 2 of the sewing machine. Meantime, the thread take-up lever 34 goes up applying tension to the upper thread The thread tension device 36 is set to provide a constant tension $T_1$ to the upper thread, which is normally specific to the type of the thread to h=used, and the intermittently operated presser 39 is operative to hold the upper thread under the control of CPU providing a tension $T_2$ to the upper thread in addition to the tension $T_1$ so that a total tension $T_3$ is applied to the upper thread. As the upper drive shaft 2 is rotated to reach the rotational angle $\theta_1$ while the thread take-up lever 34 moves to its upper dead point, and the upper shaft is further rotated past the angular position $\theta_1$ while the thread elongation disappears, and the thread progressively slackens as the thread take-up lever comes down. When the upper drive shaft 2 is further rotated to the angular position $\theta_2$ which is considerably farther from the angular position $\theta_1$ compared with the case of FIG. 10 or 12, the phase detector 32, 33 detects the angular position $\theta_2$ and provides a signal. CPU in response to the signal, makes the thread presser 39 inoperative to release the upper thread. Simultaneously the thread drawing device 55 including a lever 57 is operated to draw out the upper thread until the upper drive shaft 2 is rotated to an angular position $\theta_3$ when the thread take-up lever 34 approaches its lower dead point. The phase detector 32, 33 detects the angular position $\theta_3$ of the upper drive shaft 2 and provides a signal. CPU is responsible to the signal, makes the thread presser 39 operative to hold the upper thread again until the angular position $\theta_2$ is reached.

With respect the operation by the thread drawing instrument, the follower 57b of the thread drawing member 57 contacts the lower part of the drawing cam 59 between $\theta_0$ of the upper dead point and $\theta_2$, as shown with a curve b, and the actuating portion 57a does not contact the upper thread 5 at the part shown with the solid line of FIG. 15. At the phase $\theta_2$, the follower 57b of the drawing member 57 contacts the upper part of the drawing cam 59 and rotates, and the actuating portion 57a is positioned as shown with the dotted line in FIGS. 15 and 16 to draw the upper thread.

After having passed the phase $\theta_3$, the follower 57b of the drawing member 57 again contacts the lower part of the cam 59 and is positioned as shown with the solid line in FIGS. 15 and 16, and the actuating part 57a does not contact the upper thread 5.

The second upper thread presser device 39 is operated in synchronism with the thread drawing instrument 55. Between the phases $\theta_0$ and $\theta_2$, as shown in FIG. 5, the device 39 is imparted with the high pressure $T_2$ by the spring 60. The holding pressure added to the first holding pressure is $T_3$, and between the phases $\theta_2$ and $\theta_3$, the solenoid is operated to displace the holding disk 42 and release the pressure from the second pressure device 39, so that the pressure $T_1$ is only provided by the first presser device 36.

With respect to changings from the high pressure to the low pressure in the first and second embodiments, the thread holding pressure may show a smooth gradient as shown with the dotted line in FIG. 10.

For variances in the crossing points of the upper and lower threads due to differences in the elongation characteristics of the thread types, the invention makes use of differences by effecting elongation of the thread at the high holding pressure when the thread is drawn from the thread supply source, and by reducing the pressure when the thread is supplied, to thereby reduce elongation. Thus, the thread is supplied by the amount of this difference. Therefore, it is possible to avoid variances in the crossing points of the thread by using the elongation characteristics.

We claim:

1. A method of automatically controlling thread tension in a sewing machine comprising an upper thread source, a rotatable upper drive shaft, stitch forming means including a needle for carrying an upper thread supplied from the upper thread source, operatively connected with the upper drive shaft, and movable in vertical and lateral directions in synchronism with rotation of the upper drive shaft, a loop-taker for carrying a lower thread, operatively connected with the upper drive shaft, and rotatable in synchronism with the upper drive shaft for catching the upper thread and interlocking the upper thread with lower thread to form, in cooperation with the needle, a stitch, and a thread take-up lever operatively connected with the upper drive shaft and movable vertically downward to supply the upper thread to the needle, and upward to tighten the stitch, said method comprising the steps of:

providing a first thread tension device between the upper thread source and the thread take-up lever and operating said first thread tension device to apply a constant pressure to the upper thread such that the thread take-up lever is able to draw out the upper thread upon moving upward;

providing a second thread tension device between said first tension device and the thread take-up lever and operating said second thread tension device to fixedly hold the upper thread during movement of the thread take-up lever upward to an upper dead point thereof from a lower dead point thereof and during a downward movement of the take-up lever from a position adjacent to the upper dead point thereof to supply the upper thread to the needle; and operating said second thread tension device to effect release of the upper thread at a time when the thread take-up lever reaches the upper dead point thereof and until a time when the thread take-up lever starts said downward movement to supply the upper thread to the needle.

* * * * *